US006691333B1

(12) United States Patent
Krist

(10) Patent No.: US 6,691,333 B1
(45) Date of Patent: Feb. 17, 2004

(54) ELECTRONIC BATHROOM BATON

(75) Inventor: Robert S. Krist, 121 Holy Cross Pl., Kenner, LA (US) 70065-4055

(73) Assignee: Robert S. Krist, Kenner, LA (US)

( * ) Notice: Subject to any disclaimer, the term of this patent is extended or adjusted under 35 U.S.C. 154(b) by 0 days.

(21) Appl. No.: 10/100,309

(22) Filed: Mar. 18, 2002

Related U.S. Application Data

(63) Continuation-in-part of application No. 09/017,452, filed on Feb. 2, 1998, now Pat. No. 6,357,057, which is a continuation-in-part of application No. 08/551,630, filed on Nov. 1, 1995, now Pat. No. 5,720,055.

(51) Int. Cl.[7] ..... A47K 3/20

(52) U.S. Cl. ..... 4/420.4; 4/420.5; 4/447; 4/448; 4/420.1; 4/420.2

(58) Field of Search ..... 4/420.4, 420.5, 4/447, 448, 420.1, 420.2, 420.3, 443–446

(56) References Cited

U.S. PATENT DOCUMENTS

| | | | | |
|---|---|---|---|---|
| 1,818,388 A | | 8/1931 | Farley | |
| 2,036,985 A | | 4/1936 | Salvoni | 4/7 |
| 2,754,820 A | | 1/1956 | Gluck et al. | 4/420.1 |
| 2,985,385 A | | 5/1961 | Bowers et al. | 239/587.4 |
| 3,057,561 A | | 10/1962 | Corlett, Jr. | 239/587.4 |
| 3,882,864 A | | 5/1975 | Montgomery | 4/42.1 |
| 4,000,742 A | | 1/1977 | Digicomo | 128/229 |
| 4,287,618 A | | 9/1981 | Silver | 4/443 |
| 4,326,308 A | | 4/1982 | Silver | 4/420 |
| 4,510,630 A | | 4/1985 | Osgood | 4/443 |
| 4,596,058 A | | 6/1986 | Nourbakhsh | 4/448 |
| 4,622,704 A | | 11/1986 | Chung | 4/443 |
| 4,764,997 A | | 8/1988 | Anderson et al. | 4/420 |
| 4,933,997 A | * | 6/1990 | Kaneko | 4/420.4 |
| 5,023,961 A | | 6/1991 | Alonso | 4/443 |
| 5,067,186 A | | 11/1991 | Ayers | 4/420 |
| 5,090,067 A | * | 2/1992 | Cogdill | 4/420.2 |
| 5,263,205 A | | 11/1993 | Leunissen | 4/420.4 |
| 5,272,774 A | | 12/1993 | Ivko et al. | 4/420.4 |
| 5,295,274 A | | 3/1994 | Daniels et al. | 4/443 |
| 5,359,736 A | * | 11/1994 | Olivier | 4/448 |
| 5,384,919 A | | 1/1995 | Smith | 4/448 |
| 5,419,363 A | | 5/1995 | Robinson | 137/360 |
| 5,503,633 A | | 4/1996 | Saunders et al. | 4/340 |
| 5,659,901 A | * | 8/1997 | Derakhshan | 4/420.1 |
| 5,826,282 A | * | 10/1998 | Matsumoto et al. | 4/420.4 |
| 5,884,345 A | * | 3/1999 | Sugiyama et al. | 4/447 |
| 5,893,177 A | * | 4/1999 | Roemen et al. | 4/443 |
| 5,991,937 A | * | 11/1999 | Safara | 4/420.2 |
| 6,105,178 A | * | 8/2000 | Kurisaki et al. | 4/420.4 |
| 6,357,057 B1 | | 3/2002 | Krist | 4/420.4 |
| 6,473,913 B1 | * | 11/2002 | Bell, Sr. | 4/448 |

* cited by examiner

*Primary Examiner*—Henry Bennett
*Assistant Examiner*—Azadeh Kokabi
(74) *Attorney, Agent, or Firm*—Garvey, Smith, Nehrbass & Doody, L.L.C.; Gregory C. Smith; Charles C. Garvey, Jr.

(57) ABSTRACT

An improved Bathroom Baton apparatus which includes an electronic package designed for a one-handed operation of the water supply mechanism utilizing a membrane protective push buttons, situated on the handle, and including an electronic. module which houses battery operated solenoid valves, and electronics to facilitate the operation of the solenoid valves and battery module, in order to supply the energy to operate the components in the housing. The housing would be remotely installed at the outlet of the water supply valve which supplies water to the toilet to which the Baton is connected. There would be further provided a mercury switch in the handle to interrupt power form the battery to the electronic module when the handle is in a certain position relative to the vertical position.

10 Claims, 10 Drawing Sheets

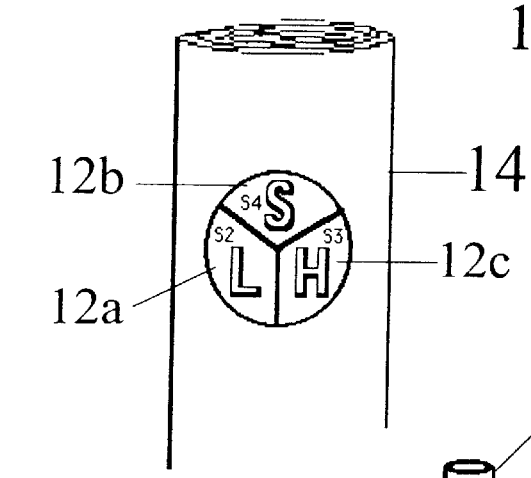
FIG 5
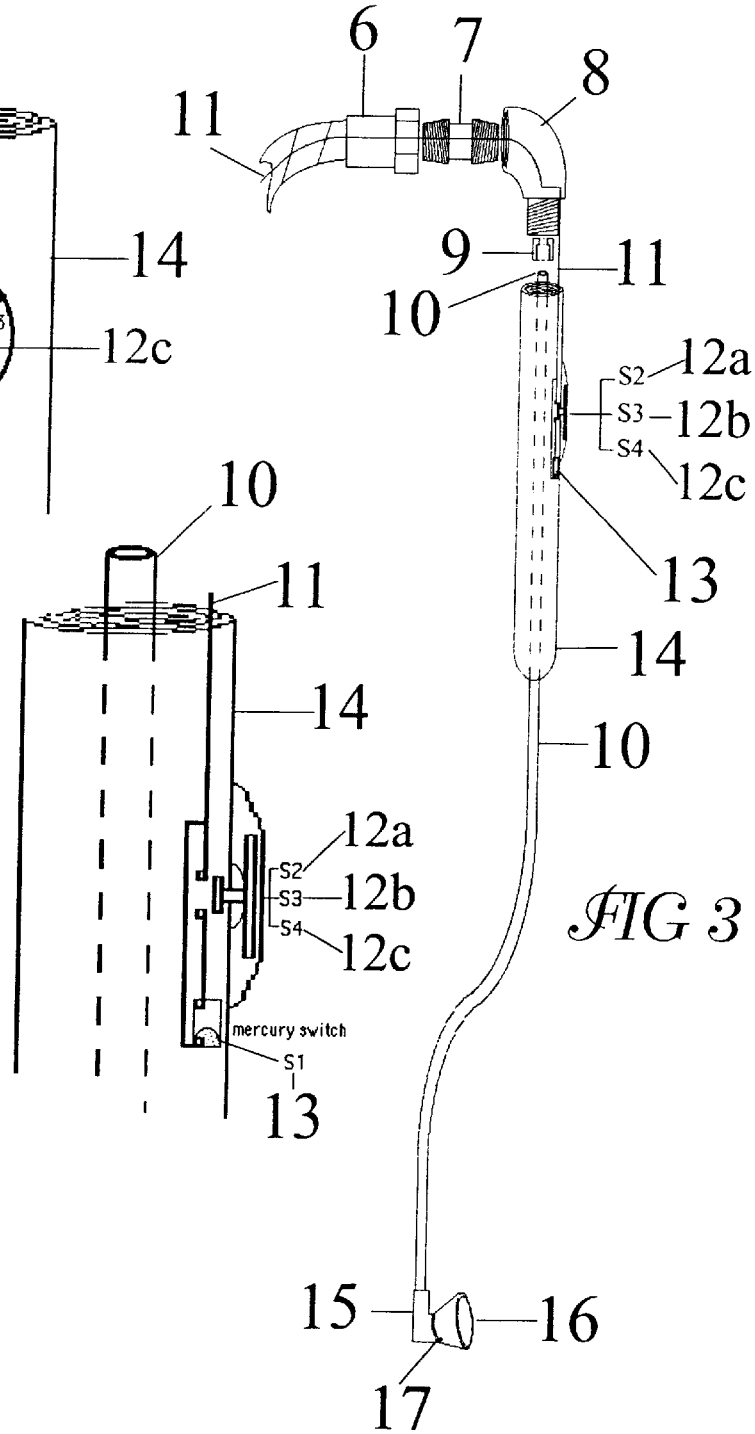
FIG 3
FIG 4

LADDER LOGIC DIAGRAM

LOGIC SEQUENCE - time 1 - SAFE MODE

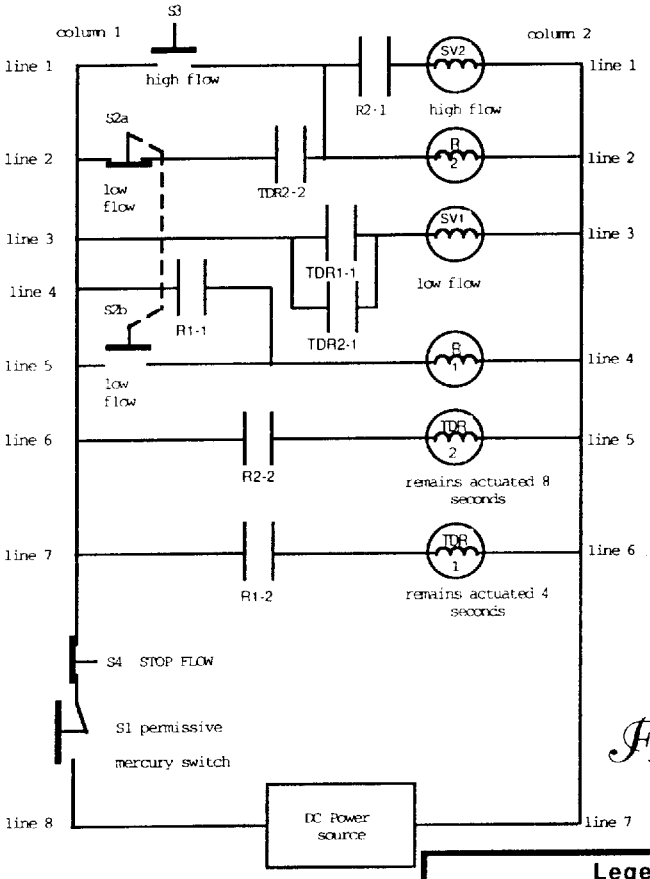

OPERATION

Column 1

Between line 7 & line 8
S1 open - by position of S1 at 90 degree position, +/- 9 degrees SYSTEM SAFE - no voltage to lines 1 through 7 of column 1

FIG 7

Legend:

SV1, SV2 = N/O, solenoid valves

TDR1 = Time Delay Relay, power to close, 4 sec delay then opens

TDR2 = Time Delay Relay, power to close, 8 sec delay then opens

R1, R2 = relay, 4pdt

S1 = N/O Mercury Switch, N/O, open at verticle (hanging), closes < 80 or >100 degrees angle

S2a, S2b = N/C & N/O Momentary Contact, Spring Return, Push Button Switch, dpdt

S3 = N/O Momentary Contact, Spring Return, Push Button Switch, spdt

S4 = N/C Spring Return, Push button Switch, spdt

|| = Normaly Open contacts

⋔ = Normaly Closed Contacts

LOGIC SEQUENCE - time 2 - READY MODE

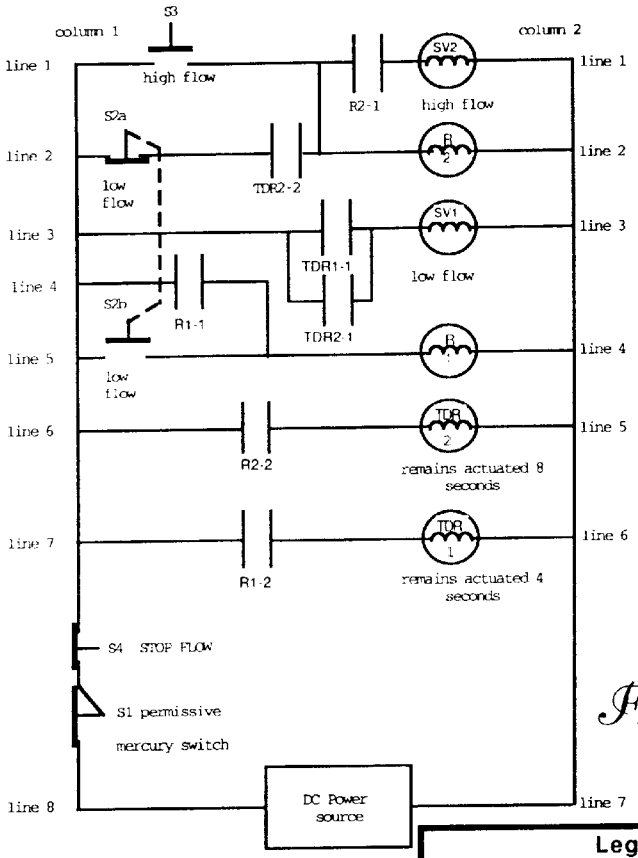

OPERATION

Column 1

Between line 7 & line 8
S1 close - by position of S1 from 90 degree position to <80 degrees or >100 degrees position SYSTEM READY - voltage to lines 1 through 7 and at S4 between line 7 & line 8 of column 1

FIG 8

Legend:

SV1, SV2 = N/O, solenoid valves

TDR1 = Time Delay Relay, power to close, 4 sec delay then opens

TDR2 = Time Delay Relay, power to close, 8 sec delay then opens

R1, R2 = relay, 4pdt

S1 = N/O Mercury Switch, N/O, open at verticle (hanging), closes < 80 or >100 degrees angle

S2a, S2b = N/C & N/O Momentary Contact, Spring Return, Push Button Switch, dpdt

S3 = N/O Momentary Contact, Spring Return, Push Button Switch, spdt

S4 = N/C Spring Return, Push button Switch, spdt

|| = Normaly Open contacts

⋔ = Normaly Closed Contacts

LOGIC SEQUENCE - time 3 - LOW FLOW

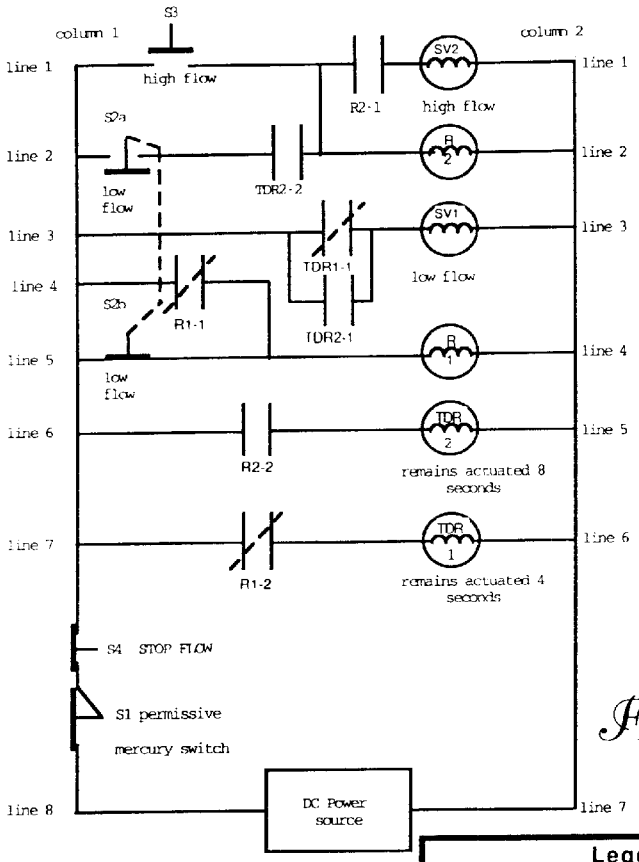

OPERATION

Column 1 line 5 = S2b close
R1 energized line 2 = S2a open line 4 = contacts R1-1 close line 7 = contacts R1-2 close
TD1 energized, 4 seconds to deactivation line 3 = contacts TDR1-1 close
SV1 activates/ opens = low flow

FIG 9

Legend:

SV1, SV2 = N/O, solenoid valves

TDR1 = Time Delay Relay,
power to close, 4 sec delay then opens

TDR2 = Time Delay Relay,
power to close, 8 sec delay then opens

R1, R2 = relay, 4pdt

S1 = N/O Mercury Switch, N/O, open at verticle (hanging),
closes < 80 or >100 degrees angle

S2a, S2b = N/C & N/O Momentary Contact, Spring Return, Push Button Switch, dpdt

S3 = N/O Momentary Contact, Spring Return, Push Button Switch, spdt

S4 = N/C Spring Return, Push button Switch, spdt

|| = Normaly Open contacts

⋊ = Normaly Closed Contacts

LOGIC SEQUENCE - time 4 - HIGH FLOW

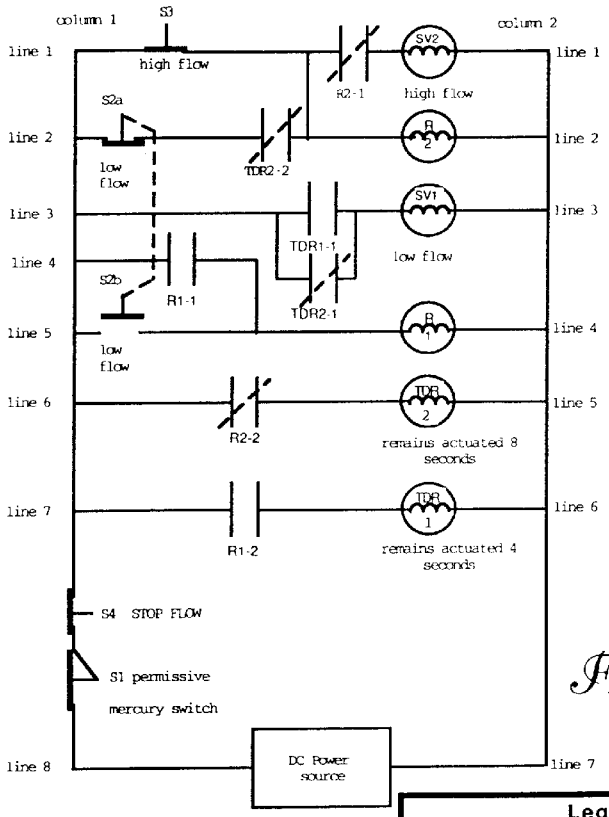

OPERATION

Column 1 line 1 = S3 close line 2 = R2 energized line 1 = contacts R2-1 close
SV2 opens = flow line 6 = contacts R2-2 close
TDR2 energizes for 8 seconds line 3 = contacts TDR2-1 close
SV1 opens = flow line 2 = contacts TDR2-2 close line 1 = S3 opens

FIG 10

Legend:

SV1, SV2 = N/O. solenoid valves

TDR1 = Time Delay Relay,
power to close, 4 sec delay then opens

TDR2 = Time Delay Relay,
power to close, 8 sec delay then opens

R1, R2 = relay, 4pdt

S1 = N/O Mercury Switch, N/O, open at verticle (hanging),
closes < 80 or >100 degrees angle

S2a, S2b = N/C & N/O Momentary Contact, Spring Return, Push Button Switch, dpdt

S3 = N/O Momentary Contact, Spring Return, Push Button Switch, spdt

S4 = N/C Spring Return, Push button Switch, spdt

|| = Normaly Open contacts

⋊ = Normaly Closed Contacts

LOGIC SEQUENCE - time 5 - LOW FLOW from HIGH FLOW

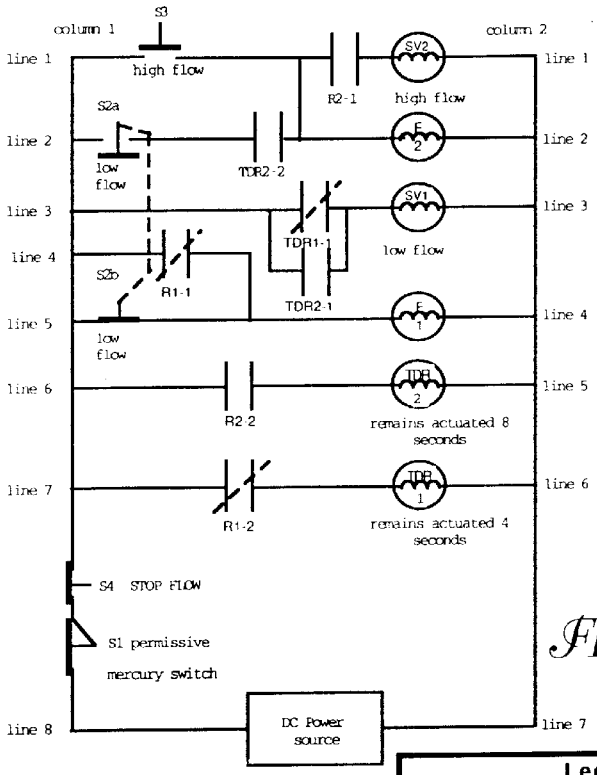

OPERATION

Column 1 line 5 = S2b close (resets low flow for 4 seconds)

line 2 = S2a open no current to R2 line 1 = R2-1 opens high flow ceases line 1 = low flow continues

FIG 11

Legend:

SV1, SV2 = N/O, solenoid valves

TDR1 = Time Delay Relay. power to close. 4 sec delay then opens

TDR2 = Time Delay Relay. power to close. 8 sec delay then opens

R1, R2 = relay, 4pdt

S1 = N/O Mercury Switch, N/O, open at verticle (hanging), closes < 80 or >100 degrees angle

S2a, S2b = N/C & N/O Momentary Contact, Spring Return, Push Button Switch, dpdt

S3 = N/O Momentary Contact, Spring Return, Push Button Switch, spdt

S4 = N/C Spring Return, Push button Switch, spdt

|| = Normaly Open contacts

+|+ = Normaly Closed Contacts

LOGIC SEQUENCE - time 6 - HIGH FLOW from LOW FLOW

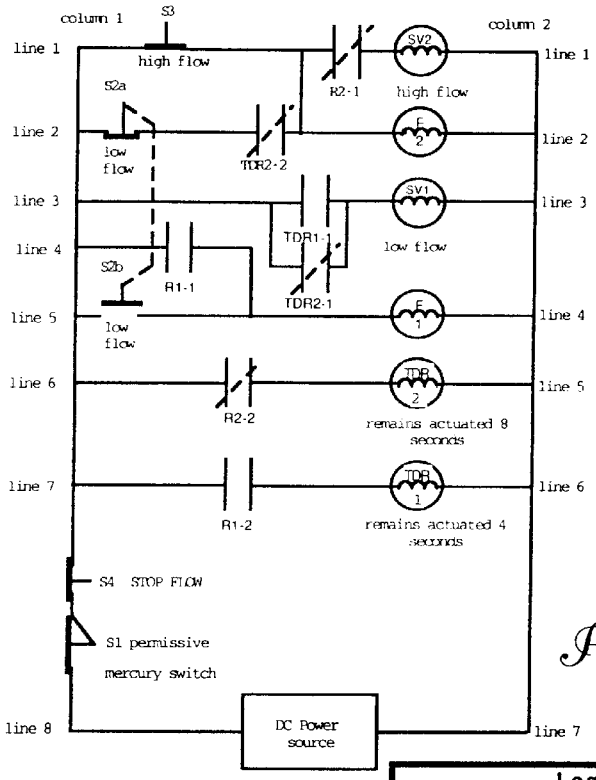

OPERATION

Column 1 line 1 = S3 close line 2 = R2 energized line 1 = contacts R2-1 close
SV2 opens = flow line 6 = contacts R2-2 close
TDR2 energizes line 3 = contacts TDR2-1 close
SV1 remains energized for 8 seconds = flow line 2 = contacts TDR-2 close

FIG 12

Legend:

SV1, SV2 = N/O, solenoid valves

TDR1 = Time Delay Relay,
power to close, 4 sec delay then opens

TDR2 = Time Delay Relay,
power to close, 8 sec delay then opens

R1, R2 = relay, 4pdt

S1 = N/O Mercury Switch, N/O, open at verticle (hanging),
closes < 80 or >100 degrees angle

S2a, S2b = N/C & N/O Momentary Contact, Spring Return, Push Button Switch, dpdt

S3 = N/O Momentary Contact, Spring Return, Push Button Switch, spdt

S4 = N/C Spring Return, Push button Switch, spdt

|| = Normaly Open contacts

⋔ = Normaly Closed Contacts

LOGIC SEQUENCE - time 7 - STOP

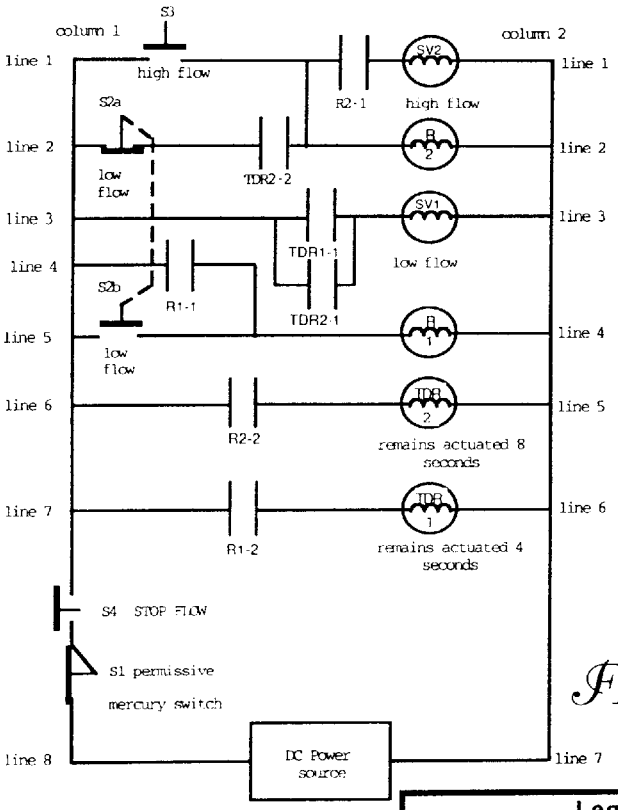

OPERATION

Column 1

Between line 7 & line 8
S4 open = no voltage to lines 1 through 7 of column 1

FIG 13

Legend:

SV1, SV2 = N/O. solenoid valves

TDR1 = Time Delay Relay.
power to close. 4 sec delay then opens

TDR2 = Time Delay Relay.
power to close, 8 sec delay then opens

R1, R2 = relay, 4pdt

S1 = N/O Mercury Switch, N/O, open at verticle (hanging), closes < 80 or >100 degrees angle

S2a, S2b = N/C & N/O Momentary Contact, Spring Return, Push Button Switch, dpdt

S3 = N/O Momentary Contact, Spring Return, Push Button Switch, spdt

S4 = N/C Spring Return, Push button Switch, spdt

|| = Normaly Open contacts

⋔ = Normaly Closed Contacts

ELECTRONIC BATHROOM BATON

CROSS-REFERENCE TO RELATED APPLICATIONS

This is a continuation-in-part of co-pending U.S. patent application Ser. No. 09/017,452, filed Feb. 2, 1998, Now U.S. Pat. No. 6,357,057 which is a continuation-in-part of U.S. patent application Ser. No. 08/551,630, filed Nov. 1, 1995, now U.S. Pat. No. 5,720,055, which are incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to personal hygienic device connectable to a conventional water system. More particularly, the present invention relates to an improved device which incorporates an electronics for use with one hand by way of membrane protected push buttons on the handle and an electronic module for facilitating the various operations.

2. General Background of the Invention

The Bathroom Baton is neither a bidet nor a sitz bath in that its primary use is to wash away fecal matter from the body by means of a pressurized spraying of water; although, a secondary use to rinse female genitalia can readily be accomplished. Whereas bidets are expressly designed to rinse female genitalia and are not, in any manner, designed to contend with fecal matter. On the other hand, unlike the Bathroom Baton which is an active device that uses a spray of water under pressure to clean and soothe the body, sitz baths are passive devices that, although expressly designed to immerse and wash the anal and genital areas of the human body, can not deal with fecal matter without touching those areas with either fingers or cloth, whereas when using the baton, only sprayed water need touch the recipient.

The advantages of bidet bathroom fixtures and sitz baths are well recognized in the art of therapeutic hygienic cleaning. Generally, bidet fixtures are mounted separately from toilet bathroom fixtures and require separate plumbing for proper operation. The disadvantage of such a separate fixture is that it necessarily occupies a space in an often limited confines of a modern bathroom and, in many cases, becomes cost prohibitive. To solve the problem, numerous patents have been issued for attachments for water closets which could serve as bidet, or personal cleaning devices, or which can be doubled as a sitz bath, when necessary.

Some of these devices disclose the use of hand-held shower heads mounted on a handle which also carries an actuating control valve. Others suggest the use of a showerhead with a rigid handle which is connected to a conventional faucet to allow delivery of water to the showerhead and facilitate personal cleansing of a person seated on a toilet. Still others suggest the use of specially adapted toilet seats to accommodate a showerhead with a nozzle that is supported under the toilet seat to direct the water upward. However, none of the above mentioned devices provides for the use of a hygienic device that can be also used to facilitate clearing of drainage clogs or a device that can be used during diaper changes of a baby. Furthermore, none of these other devices is capable of delivering a non-invasive enema or colonic On Feb. 24, 1998, the inventor was granted U.S. Pat. No. 5,720,055, entitled "Cleaning and Hygienic Device",which improved prior art devices in this field. The inventor then filed an improved version of the cleaning device which comprises an elongated flexible tubing, one end of which is adapted for connection to a source of water supply. A fluid control valve is secured to one end of the tubing to regulate the flow of water through the tubing. A rigid hollow handle is secured to an outlet of the flow control valve, the handle carrying a vented spray nozzle at its free end, with the spray nozzle provided with a plurality of openings. A connecting member retains the spray nozzle at an acute angle in relationship to a longitudinal axis of the handle so as to direct a flow of water exiting through the openings upwardly when the cleaning device is in use. The handle is long enough to extend from an outside confines of a toilet bowl to a location immediately above the toilet bowl. When the device is in use, the control valve appears on the outside of the toilet bowl, in front of the user seated on the toilet bowl. This improved version also taught alternative embodiments.

SUMMARY OF THE PRESENT INVENTION

The present invention is again an improved version of the two devices which were patented by the present inventor and again improves the device a great deal by teaching an easy to use, one hand controlled, electronic device. What is provided is an improved Bathroom Baton apparatus which includes an electronic package designed for a one-handed operation of the water supply mechanism utilizing a membrane protective push buttons, situated on the handle, and including an electronic module which houses battery operated solenoid valves, and electronics to facilitate the operation of the solenoid valves and battery module, in order to supply the energy to operate the components in the housing. The housing would be remotely installed at the outlet of the water supply valve which supplies water to the toilet to which the baton is connected.

Therefore, it is the principal object of the present invention to provide an electronic version for the Bathroom Baton which allows for a one-handed operation of the water supply mechanism of the baton, in order to operate the baton;

It is a further object of the present invention to provide an electronic Bathroom Baton which no longer utilizes manual control valves which require two-handed operation, but where it is electronic in its operation and is powered by a battery module in order to operate the apparatus;

It is a further object of the present invention to provide an electronic Bathroom Baton which has a multiple flow function, and a safe function when the baton is not in use so that the electronics controlling the operation of the baton are not energized while the baton is in the safe mode;

It is a further object of the present invention to provide an electron Bathroom Baton with multiple modes so that the baton may go from the safe mode to the low flow mode then to the high flow mode and can return to the low flow mode and the safe mode, during use of the baton due to the electronics within the baton.

BRIEF DESCRIPTION OF THE DRAWINGS

The need be pointed out that the components of the electronic diagrams used in this explanation are for the express purpose of clarity of explanation only and that the final products will, in all probability, be composed of a low voltage, low current solid state device or devices such as an IC, integrated circuit or such newer technology but does not rule out or preclude using discrete components to achieve the operational parameters as described in this document.

For a further understanding of the nature, objects, and advantages of the present invention, reference should be had to the following detailed description, read in conjunction with the following drawings, wherein like reference numerals denote like elements and wherein:

FIG. 3 illustrates an overall view of the switching mechanism located on the handle of the electronic baton;

FIGS. 4 and 5 illustrate front and side partial views of the handle portion of the electronic baton;

FIG. 7 illustrates the logic sequence for the safe mode of the present invention;

FIG. 8 illustrates the logic sequence of the ready mode of the present invention;

FIG. 9 represents the logic sequence of the low flow mode of the present invention;

FIG. 10 illustrates the logic sequence for the high flow mode of the present invention;

FIG. 11 illustrates the logic sequence of the present invention going from the low flow mode from the high flow mode;

FIG. 12 illustrates the logic, sequence of the present invention going from the high flow mode from the low flow mode; and FIG. 13 illustrates the logic sequence with a stop mode of the present invention.

DETAILED DESCRIPTION OF THE INVENTION

Figure 6:
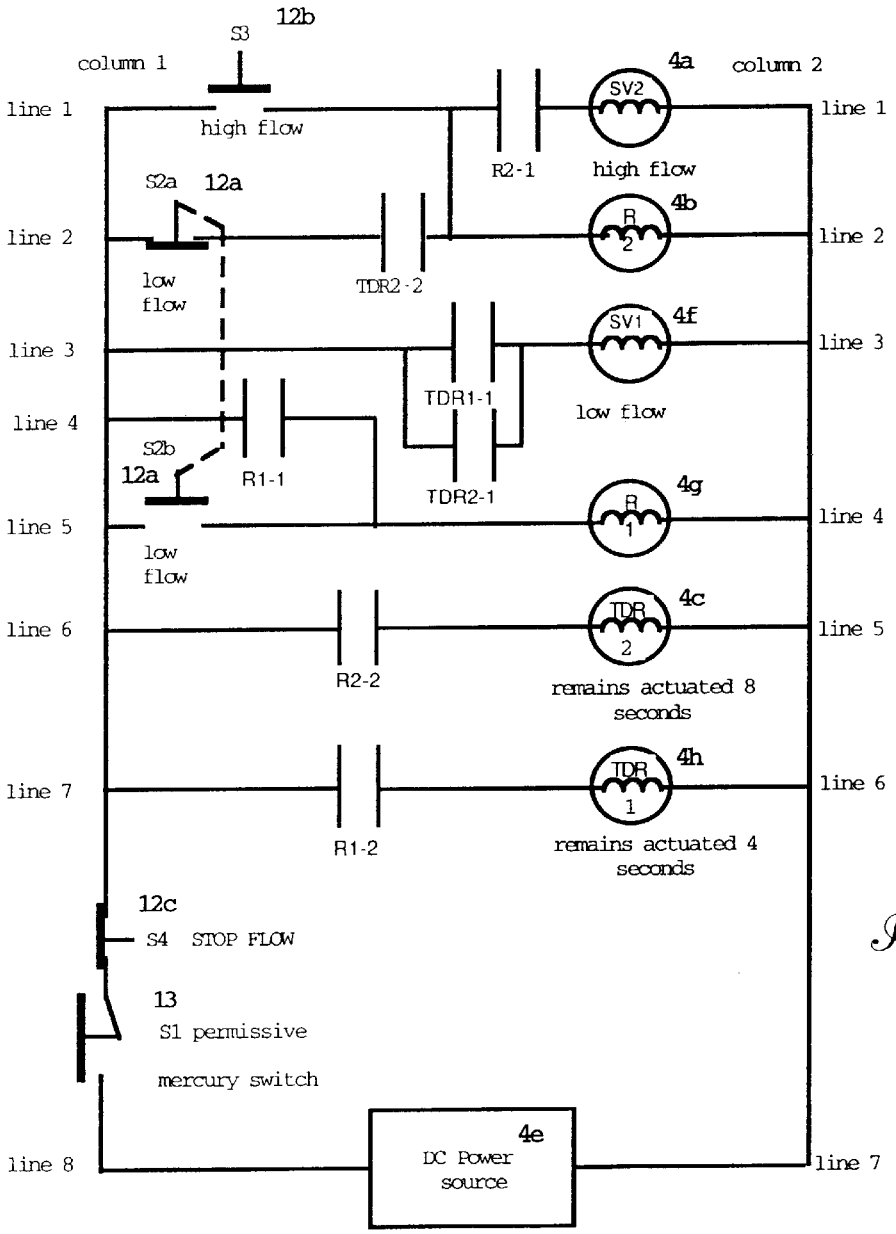
FIG. 6 illustrates the ladder logic diagram of the electronics of the present invention.

FIGS. 1 through 5 illustrate a pictorial illustration of the electronic embodiment of the present invention, with FIGS. 6 illustrating the Ladder Logic Diagram, and FIGS. 7 through 13 illustrating in logic sequence the various modes of operation of the present invention.

Figure 2:
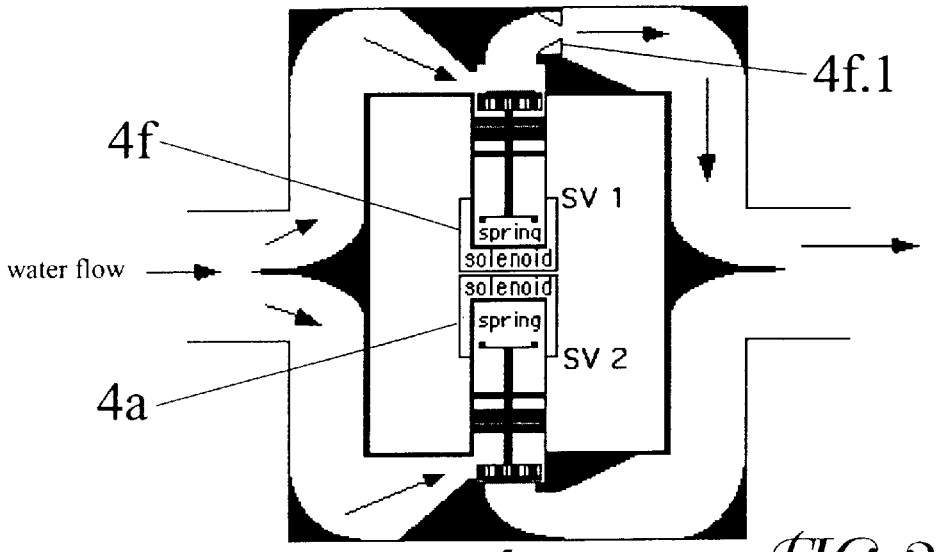
FIG. 2 illustrates an isolated view of the water flow mechanism through the baton.
Figure 1:
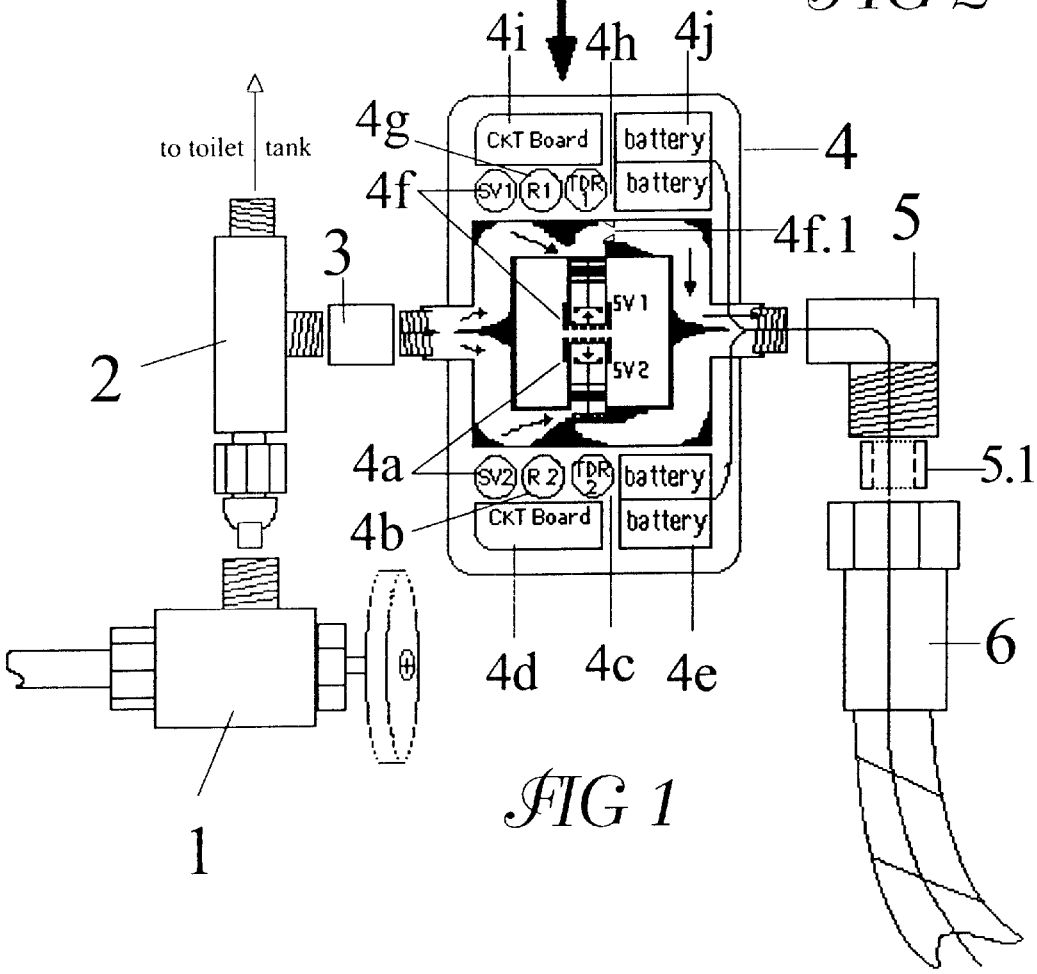
FIG. 1 illustrates an overall view of the electronics provided in combination with the water flow mechanism to operate the baton.

As was stated earlier, this embodiment of the Bathroom Baton differs from the original Bathroom Baton in execution but remains the same in both concept and in regard to is ergonomic facility. This new embodiment differs from the original, such that, where the original embodies a manually operated control valve that required the use of two hands to operate it, so to supply and regulate water flow through the spray head 17, as seen in FIG. 3, the new electronic version is specifically designed for one handed operation of the water supply mechanism by way of membrane protected push buttons 12*a*, 12*b*, 12*c* located on and in the handle 14 and an electronic module 4 that houses battery operated solenoid valves 4*a* & 4*f*, electronics 4*b*, 4*c*, 4*d*, 4*g*, 4*h*, 4*i* to facilitate the operation of those solenoid valves 4*a* & 4*f*, and battery module 4*e*, as seen in FIGS. 1 and 2. Column 1, line 8 and Column 2, line 7, of the ladder logic diagram in FIG. 6, show the energy supply to operate such components in said housing module 4. Module 4 is to be remotely located/installed at the outlet of the water supply valve 1 which supplies water to that toilet to which that Baton is connected, as seen in FIG. 1.

This newest incarnation, termed The Bathroom Baton, Electronic Version or Model-E, also differs in execution to the manual Bathroom Baton in that the hose 6, illustrated in FIG. 1, no longer is required to be a pressurized vessel, but rather a conduit through which water flows. The only pressure that the hose 6 would be subject to is that imposed by that restriction offered by the shower-head 16 as is well within the design parameters of said shower hoses.

Also differentiating the "E" model from both the "A" (automatic valve) model and the "M" (manual valve) model of the Bathroom Baton, is that of the water connection which is usually composed of components 2, 3, 5, and 5.1, as seen in FIG. 1, are assembled to comprise a single component. On this newest "E" model, items 2 and 3 comprise the inlet to the electronics valve module 4, and items 5 and 5.1 comprises the outlet to that same module, as seen in FIG. 1. Item 5.1, it might be noted, is an insert to item 5, the sole purpose to provide increased surface area so to better facilitate and insure an adequate seal for the gasket that interfaces between the connector, item 5 and hose, item 6.

To reiterate, the most notable differences between the two previous models and this newest "E" model is that both the "A" and the "M" models comprise manual control valves requiring two handed operation, where this "E" model is electronic in its operation, requires but one handed operation, and is powered by a battery module 4*e*, as seen in FIG. 1, which when energized operates the various modes of the invention, as will be discussed further.

The electronic functioning of the present invention incorporates special features in order to operate in its various modes. For example, there is provided a mercury switch S1, as seen on the various operational schematics in FIGS. 7 through 13, and item 13 in FIG. 3. The switch 13 is so installed that its contacts present an open circuit to all other electronic components when the Baton is installed in its hanger which places the Baton in a 90 degree or vertical position with respect to the ground or floor. This switch 13 remains open at 90 degrees+/−9 degrees of positional attitude. The switch is designed to close only when the Baton is removed from its hanger and is at angles either <80 degrees or >100 degrees. Only then is voltage supplied to switches S2 (12*a* in FIG. 4), S3 (12*b*), S4 (12*c*) to permit operation of the Baton.

By relocating the control module 4 from the handle 14 of the Baton to the inlet water supply valve 1, the hose 6 is no longer required to act as a pressure vessel, but as a conduit as was intended by the design of its manufacturers.

Still, another benefit of relocating the control module 4 from the handle 14 of the Baton to the inlet water supply valve 1 is a decrease in weight of the hand held portion of the Baton by approximately 60% which equates to an even easier to use, more ergonomically comfortable product.

Turning now to the logic diagrams. For purposes of clarity, some of the references to components in the logic diagrams will be identified by the number in the diagram and also by the number in parentheses. The parenthetical numeral represents the component as was illustrated in the pictorial drawings in FIGS. 1 through 5.

Turning first to logic sequence in FIG. 6, it should be noted that FIG. 6, the ladder logic diagram represents the apparatus in the safe mode as in illustrated in the logic sequence in FIG. 7. For purposes of explanation, each logic sequence illustrated in FIGS. 7 through 13, to represent the various operational modes of the apparatus, there is provided a Legend and an Operation Box to help explain and illustrate the electronic functioning of the apparatus in that particular mode of operation.

Turning now to FIGS. 6 and 7, the apparatus is illustrated in the Safe Mode; that is the Baton in positioned in the hanger (90 degrees, vertical) In Column 1, between Line 7 & Line 8—mercury switch S1 (13) is open due to the 90-degree,+/−9 degrees, position of the Baton. No voltage is present at either Stop Switch S4 (12*c*) or lines 1 through 7, Column 1, of the circuit/ladder diagram.

Turning now to FIG. 8, the baton is in the ready mode; that is the Baton has been removed from hanger (<80 degrees,>100 degrees) In Column 1—between line 7 and line 8—mercury switch S1 (13) closes when the Baton is moved from its 90 degree position to another position that is <80 degrees or >100 degrees from its hanging position. Voltage is now present at the N/C contacts of Stop Switch (12*c*), S4 between line 7 and line 8, the N/C contacts of the Low Flow Switch (12*a*) S2*a* between line 7 and line 8, and to lines 1 through 7 of the Ladder Diagram.

Turning now to FIG. 9, Time 3—Low Flow. As illustrated in the diagram, when the momentary contact push button S2 (12*a*), which comprises both N/C contacts (S2*a*) and N/O contacts (S2*b*), is pushed, Line 5—the N/O contacts of S2*b* (12*a*) closes allowing current to flow to R1 (4*g*) . The energizing of R1 (4G) causes, Line 4—N/O contacts R1-1 to close. This provides an alternate current path to R1, line 5 (4*g*) when S2 (12*a*) opens. Closed contacts S2*b*, line 4, return to the N/O position. Simultaneous to R1 (4*g*) energizing and N/O contacts R1-1 closing, Line 7—N/O contacts R1-2 close. This allows TD1 (4*h*) to energize for 4 seconds and Line 3—N/O contacts TDR-1 to close. SV1 (4*f*) is thus energized and opens. Low water flow occurs for 4 seconds. Simultaneous with the pushing of S2 (12*a*),Line 2—N/C contacts S2*a* (12*a*) open, thus ending a high flow condition, should the components be in that mode.

Reference now is made to FIG. 10—Time 4—High Flow: When momentary N/O contact push button S3 (12*b*) is pushed, Line 1—N/O high flow switch, S3 (12*b*) momentarily closes allowing current flow to R2 (4*b*). Line 2—R2 (4*b*) is energized causing Line 1—N/O contacts R2-1 to close. As this occurs, Line 1—SV2 (4*a*) is energized and opens. Line 6—N/O contacts R2-2 close TDR2 (4*c*) energizes for 8 seconds. Line 3—N/O contacts TDR2-1 closes and SV1 (4*f*) is energized and opens. At this moment when both SVI (4*a*) & SV2 (4*f*) are energized and their respective valves are open, high water flow occurs. Line 2—N/O contacts TDR2-2 close, locking in a current path to SV2 (4*a*) on line 2 and to R2 (4*b*) on line 1. Line 1—S3 (12*b*) opens, but the current path to both SV2 (4*a*) and R2 (4*b*) continues for 8 seconds until TDR2 (4*c*) times out.

Reference is now made to FIG. 11—Time 5—Low flow From High Flow: When the momentary contact Low Flow push button switch S2 (12*a*), which comprises both N/C contacts S2*a*, line 2, and N/O contacts S2*b*, line 5, is pushed, while the high flow components are activated and in the High Flow condition, Line 5—the N/O contacts of S2*b* (12*a*) closes allowing current to flow to R1 (4*g*) R1 (4*g*) is energized causing Line 4—N/O contacts R1-1 to close. This provides an alternate current path to R1, line 5, (4*g*) when S2 (12*a*) opens, and the closed contacts S2*b*, line 4, return to their N/O position. Simultaneous to R1 (4*g*) energizing and N/O contacts R1-1 closing, Line 7—N/O contacts R1-2 close. This allows TD1 (4*h*) to energize for 4 seconds and Line 3—N/O contacts TDR-1 to close. SV1 (4*f*) is thus energized and opens. Low flow thus occurs for 4 seconds. Simultaneous with the pushing of S2 (12*a*) and the closing of contacts S2*a*, line 2,—Line 2B, N/C contacts S2*a* (12*a*) open, thus ending the high flow condition.

Reference is now made to FIG. 12—Time 6—High flow From Low Flow: When momentary N/O contact push button S3, line 1, (12*b*) is pushed, Line 1—N/O high flow switch, S3 (12*b*) momentarily closes allowing current to flow to Line 2—R2 (4*b*). SV2 (4*a*) energizes and its N/C valve opens=flow. Line 2—R2 (4*b*) is energized causing Line 1—N/O contacts R2-1 to close and Line 6—N/O contacts R2-2 to close which allows current to flow to TDR2 (4*c*). TDR2 (4*c*) energizes causing Line 3—N/O contacts TDR2-1 to close continuing the energizing of SV1 (4*f*), its valve remains open and flow continues even though TDR1, line 7, (4*h*) times out and contacts TDR1-1, line 3, open, and Line 2—N/O contacts TDR2-2 to close maintaining current flow to R2 (4*b*) until TDR2 (4*c*) times out. It should be made clear that the simultaneous energizing of SV1, line 3, (4*f*) and SV2, line 1, (4*a*) and the corresponding opening of their respective valves results in the desired condition of high water flow through the Spray Head (16).

The final mode of operation is illustrated in FIG. 13—Time 7—STOP: When momentary N/O contact push button S4, Column 1, between line 7 and line 8 (12*c*), is pushed, Column 1—Between Line 7 and Line 8—S4 (12*c*) opens and voltage to lines 1 through 7 ceases resulting in SV1, line 3, and SV2, line 1, deactivating, their respective valves closing resulting in a cessation of water flow through the Spray Head (16).

In summary, the unique design of this new Electronic Bathroom Baton incorporates five fail-safe parameters: 1st Parameter—Pushing both the Low Flow Button (12*a*) S2, comprising N/C S2*a*, line 2, and N/O S2*b*, line 5, and the High Flow Button S3, line 1, (12*b*) simultaneously results in the Low Flow of water from the Spray Head (16) for four seconds, then the ceasing of water flow. This parameter insures that a high-pressure spray of water does not unexpectedly surprise the user. 2nd Parameter—Pushing all three buttons on the Baton handle simultaneously results in the in-operation of the Baton in that the Stop Button S4, Column 1, between line 7 and line 8, (12*c*) is in the primary chain of operation of the electrical circuitry of the Baton. 3rd Parameter—Pushing the STOP Button causes an immediate cessation of water flow by removing voltage to Column 1, lines 1 through 7 returning that circuitry to its at rest/fail safe/no flow condition. 4th Parameter—In the possibility that either the Low Flow Button (12*a*) S2, comprising N/C S2*a*, line 2, and N/O S2*b*, line 5, or the High Flow Button S3, line 1, (12*b*) sticks or fails in the closed position, by means of circuit design, TDR1, line 7, (4*h*), and TDR2, line 6, (4*c*), limits unattended water flow for a maximum of 8 seconds minimizing possible flooding of water by the unattended Baton. 5th Parameter—Because of Mercury Switch S1, column 1, between line 7 and line 8, (13), located in the handle (14), both the Low Flow Button (12*a*) S2, comprising N/C S2*a*, line 2, and N/0 S2*b*, line 5, and/ or the High Flow Button S3, line 1, (12*b*), located in the handle, will not operate when the Baton is in a 90 degree position in its hanger.

As an alternative, by removing contacts TDR2-1, line 3, and resizing both SV1 (4*f*), line 3 and SV2 (4*a*), line 1 accordingly and the corresponding restriction orifice 4*f*.1 located in the flow path of SV1, current demands of this product design can be greatly lessened as well as a lessening of parts inventory in that both valves can be the same size.

The foregoing embodiments are presented by way of example only; the scope of the present invention is to be limited only by the following claims.

What is claimed is:

1. A cleaning device, for use with a personal hygiene toiletry fixture, and a source of fresh water supplied to the toiletry fixture, the cleaning device comprising:

a. an elongated tubing having two ends, a first end of the tubing adapted for connection to the fresh water source supplied to the toiletry fixture and a second end allowing water from the tubing;

b. a hand-held handle mounted in fluid communication with said tubing;

c. an electronic flow control module positioned in line with the water flow and apart: from the handle portion; and d. a switch operable on the handle portion for controlling the operation of the electronic flow control module through various operational modes of the apparatus; and e. a mercury switch which interrupts power from the direct current source to the electronic flow control module that is in electrical communication with the electronic flow control module when the handle portion is positioned more than 10 degrees or less than 10 degrees from the vertical position.

2. The cleaning device in claim 1, wherein the electronic control module comprises electronic components to control the water flow through the module in the multiple operational modes.

3. The cleaning device in claim 1, wherein the electronic control module is powered by a source of direct current.

4. The cleaning device in claim 1, wherein the operational modes of the electronic flow control module comprise a stop mode, low flow mode, high flow mode, low to high flow mode, high to low flow mode, and a resting mode.

5. The cleaning device in claim 1, wherein the switch operable on the handle includes a plurality of buttons to operate the apparatus in the various prescribed modes with the use of one hand, positioned outside the confines of the toilet bowl and so positioned that when using the apparatus, the thumb of the user points away from the users body, and when used on a recipient by another person, the user's thumb points toward the recipient's body.

6. The cleaning device in claim 1, wherein the electronic flow control module is positioned adjacent the first end of the elongated tubing.

7. The cleaning device in claim 1, wherein there is provided electronic time out limiting functions in both the low flow and high flow modes of operation.

8. A cleaning device, for use with a personal hygiene toiletry fixture, and a source of fresh water supplied to the toiletry fixture, the cleaning device comprising:

a. an elongated tubing having two ends, a first end of the tubing adapted for connection to the fresh water source supplied to the toiletry fixture and a second end allowing water from the tubing;

b. a hand-held handle mounted in fluid communication with said tubing;

c. a direct current-operated electric flow control valve module positioned in line with the fluid flow adjacent the first end of the tubing;

d. an electrical switch located on the handle portion for controlling the flow of water through the electric flow control valve module by the functioning of the electronic flow control module, operating between a stop mode, a low flow mode, a high flow mode, and a resting mode as well as multiple operational modes in the design of the prescribed electrical circuitry; and e. a mercury switch which interrupts sower from the direct current source to components within the electronic control valve module that supply electrical current to the electric control valve module when the handle portion is positioned less than 10 degrees from the vertical.

9. The cleaning device in claim 8, wherein the electronic control module comprises electronic components to control the fluid flow through the module in the multiple operational modes.

10. A cleaning device operable with one hand, for use with a personal hygiene toiletry fixture, and a source of fresh water supplied to the toiletry fixture, the cleaning device comprising:

a. an elongated tubing having two ends, a first end of the tubing adapted for connection to the fresh water source supplied to the toiletry fixture and a second end allowing water from the tubing for cleaning;

b. a valving mechanism attaching the tubing to the fresh water source to the toilet fixture;

c. a hand-held handle mounted along the tubing and in fluid communication with said tubing;

d. a battery-operated electronic flow control module positioned in communication with the valving mechanism to control water flow through the tubing;

e. a switch operable on the handle portion for controlling the flow of water through the electronic flow control module between a stop mode, a low mode, a high mode, a resting mode and multiple operational modes; and f. a mercury switch positioned on the handle which interrupts power from the battery to the electronic control valve when the handle portion is positioned less than 10 degrees from the vertical.

* * * * *